US011684225B2

(12) United States Patent
Kawamoto et al.

(10) Patent No.: US 11,684,225 B2
(45) Date of Patent: Jun. 27, 2023

(54) PORTABLE BLOWER

(71) Applicant: Yamabiko Corporation, Tokyo (JP)

(72) Inventors: Tetsuya Kawamoto, Tokyo (JP); Shota Nishihara, Tokyo (JP); Tomohiro Miyanishi, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 898 days.

(21) Appl. No.: 16/402,436

(22) Filed: May 3, 2019

(65) Prior Publication Data

US 2020/0085265 A1 Mar. 19, 2020

(30) Foreign Application Priority Data

Sep. 19, 2018 (JP) ..... 2018-174740

(51) Int. Cl.
*A47L 5/14* (2006.01)
*A47L 5/36* (2006.01)

(52) U.S. Cl.
CPC .. *A47L 5/14* (2013.01); *A47L 5/36* (2013.01)

(58) Field of Classification Search
CPC . F16L 37/12; F16L 23/04; F16L 13/14; F16L 37/244
USPC ..... 15/405, 326, 239, 420, 406
See application file for complete search history.

(56) References Cited

U.S. PATENT DOCUMENTS 1,583,528 A * 5/1926 Clements ..... A47L 5/14 15/328
5,806,133 A * 9/1998 Iida ..... A47L 5/24 15/412
2004/0216262 A1* 11/2004 Taomo ..... A47L 5/36 15/327.5

FOREIGN PATENT DOCUMENTS

JP 2017008685 A 1/2017

* cited by examiner

*Primary Examiner* — Katina N. Henson
(74) *Attorney, Agent, or Firm* — Withrow & Terranova, P.L.L.C.

(57) ABSTRACT

Provided is a portable blower including a portable main body in which a pipe base portion of a blowout pipe is connected to an outlet port of a fan case, wherein, the fan case is formed of a fiber-reinforced resin of low specific gravity, the pipe base portion has a bent shape and is connected slidably to a pipe connecting portion of the outlet port, and a slide-contact-receiving member that is formed of a wear-resistant material is attached to the pipe connecting portion at a slide-contact point of the pipe base portion.

9 Claims, 6 Drawing Sheets

PORTABLE BLOWER

RELATED APPLICATION

This application claims priority to Japanese Patent Application No. 2018-174740, filed on Sep. 19, 2018, the disclosure of which is hereby incorporated herein by reference in its entirety.

TECHNICAL FIELD

The present invention relates to a portable blower having a blowout pipe for blowing out an air flow.

BACKGROUND

A portable blower is a tool in which a fan thereof is driven using a prime mover such as an engine or an electric motor equipped therein, to perform, using an air flow ejected from the fan, a cleaning work collecting fallen leaves, dust and the like or a collecting work collecting chopped grass and the like. The basic constitution of the portable blower is such that a portable body, which may be a backpack type or a handheld type, is equipped with the above-mentioned prime mover and the fan, and a blowout pipe for blowing out the air flow is connected to a fan case of the fan.

In a conventional portable blower, a bent base portion of a blowout pipe, the base portion having an operation lever, is connected to an outlet port of the fan case opened downward. Holding the operation lever, an operator of the portable blower performs the works described above by blowing out an air flow while changing the direction of the blowout port of the blowout pipe.

RELATED LITERATURE

Patent Literature

[PTL 1] Japanese Patent Application Laid-open No. 2017-8685.

SUMMARY

Technical Problem

The conventional portable blower described above has a structure in which, since the direction of the blowout port of the blowout pipe is changed repeatedly during a task, the bent base portion of the blowout pipe is connected slidably to the outlet port of the fan case. In this type of portable blower, attempting to increase the pressure and volume of the air flow to be blown out leads to an increase in the output of the prime mover and an increase in the diameter of the blowout pipe, resulting in enlargement of the main body. Enlargement of the main body leads to an increase in the weight of the portable blower, which eventually increases the physical burden on the operator and consequently drops the productivity. For this reason, reducing the weight of the main body is required in order to reduce the workload.

As a way to reduce the weight of the main body in order to meet this requirement, use of a fan case made of a fiber-reinforced resin of low specific gravity is considered. However, a fan case made of a fiber-reinforced resin of low specific gravity easily causes some new problems, for example, the connection between the outlet port of the fan case and the base portion of the blowout pipe ("pipe base portion," hereinafter) is easily worn due to a sliding motion of the pipe base portion with respect to the outlet port, and as a result, a fitting portion of the connection, for example, becomes shaved, causing the blowout pipe to wobble with respect to the fan case, thereby reducing workability or, in some cases, a failure of falling off of the blowout pipe is easily occurred.

The present invention was contrived in order to address such problems. Specifically, in reducing the weight of the fan case for the purpose of reducing the workload, the present invention aims to prevent wobbling and removal of the blowout pipe having the pipe base portion connected to the outlet port of the fan case.

Solution to Problem

In order to achieve this object, the present invention includes the following constitution.

A portable blower including a portable main body in which a pipe base portion of a blowout pipe is connected to an outlet port of a fan case, wherein, the fan case is formed of a fiber-reinforced resin of low specific gravity, the pipe base portion has a bent shape and is connected slidably to a pipe connecting portion of the outlet port, and a slide-contact-receiving member that is formed of a wear-resistant material is attached to the pipe connecting portion at a slide-contact point of the pipe base portion.

Advantageous Effects of Invention

According to the portable blower characterized as above, because the fan case is formed of a fiber-reinforced resin of low specific gravity, the weight of the main body can be reduced, thereby reducing the workload of the portable blower which can be used for tasks while carrying the main body on back. In addition, even when a task involving sliding of the pipe base portion of the blowout pipe is repeatedly performed, attaching the slide-contact-receiving member formed of a wear-resistant material to the slide-contact point of the pipe base portion in the pipe connecting portion can prevent such problems as wobbling and removal of the blowout pipe attributed to wear of the pipe connecting portion.

DETAILED DESCRIPTION

Description of Embodiment

Figure 1:
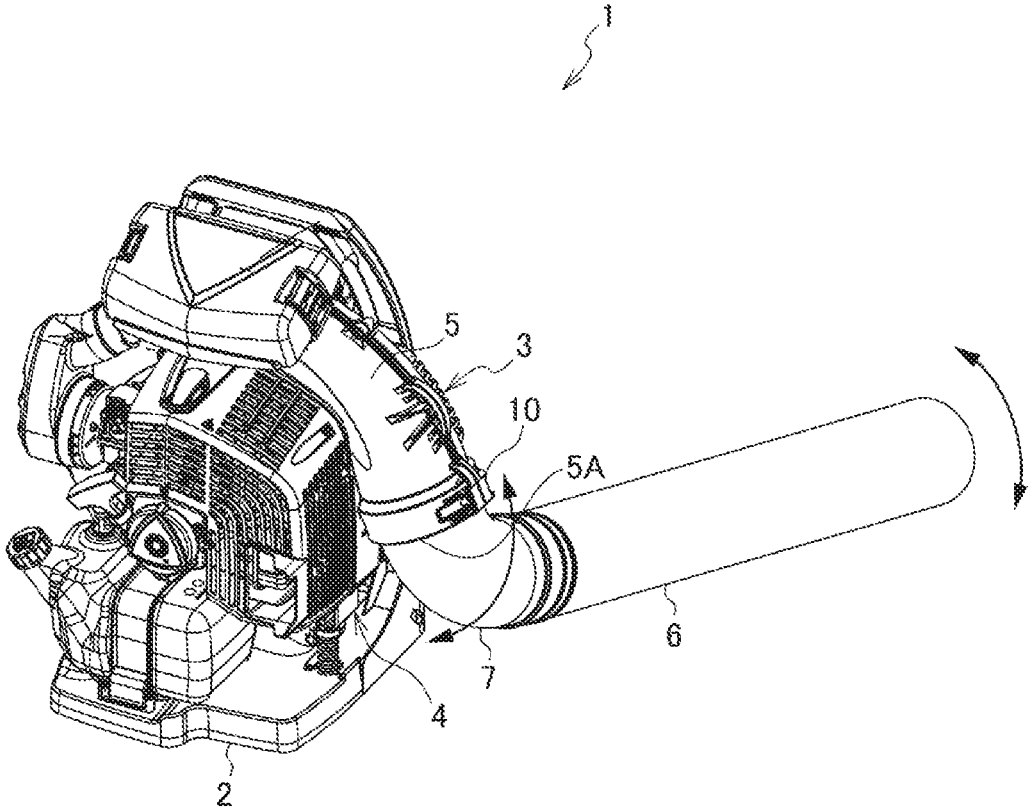
FIG. 1 is an explanatory diagram showing an entire constitution of a portable blower according to an embodiment of the present invention.

An embodiment of the present invention is now described hereinafter with reference to the drawings. In the following description, like reference numerals shown in different drawings represent parts with like functions, and redundant descriptions of the drawings are omitted accordingly.

As shown in FIG. 1, in a portable blower 1, a main body installed in a backpack-type machine frame (backpack base) 2 is equipped with a fan 3 and a prime mover 4. The fan 3 includes a fan case 5 having an outlet port 5A. The prime mover 4 includes, for example, an engine and a fuel tank for supplying fuel to the engine, or a motor and a battery functioning as a driving power supply of the motor.

In the portable blower 1, a pipe base portion 7 of a blowout pipe 6 is connected to the outlet port 5A of the fan case 5. As shown by the arrow in FIG. 1, the pipe base portion 7 is connected slidably to a pipe connecting portion 10 of the outlet port 5A in order to allow a tip of the blowout pipe 6 to be directed in various directions.

A space in which air flows is formed inside the fan case 5 by sticking a pair of split bodies together. Similarly, the pipe connecting portion 10 of the fan case 5 is formed by a pair of split bodies divided into two, wherein the pipe base portion 7 is clamped by this pair of split bodies and one end portion of the pipe base portion 7 is connected to the pipe connecting portion 10. A pipe main body of the blowout pipe 6 or a flexible pipe portion is connected to the other end portion of the pipe base portion 7 formed in a bent shape.

The fan case 5 and the pipe connecting portion 10 of the fan case 5 are each formed of a fiber-reinforced resin of low specific gravity in order to reduce the weight of the main body. More specifically, carbon fiber reinforced polypropylene having a specific gravity of 1.1 or less, such as PP-CF20, can be used as the material for forming the fan case 5 and the pipe connecting portion 10.

Figure 2:
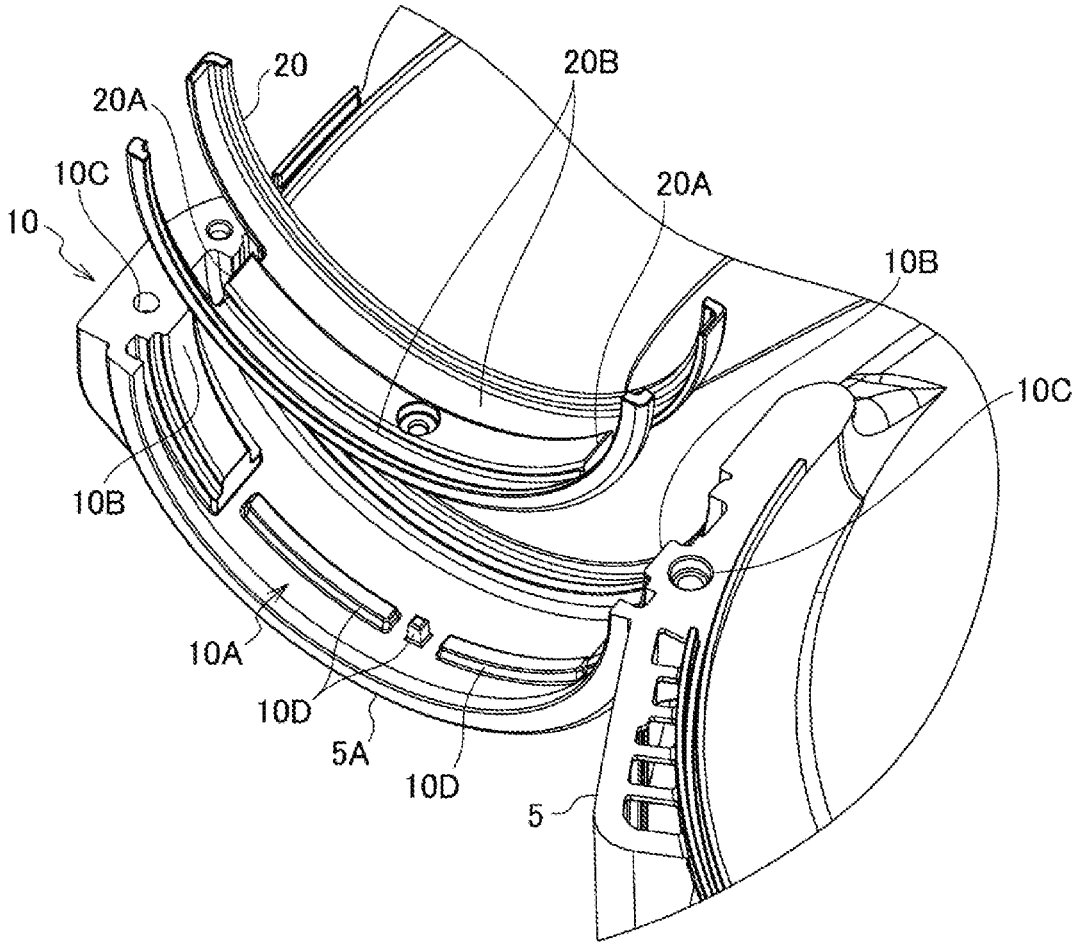
FIG. 2 is a perspective view showing an internal structure of a pipe connecting portion of the portable blower (before a slide-contact-receiving member is attached)
Figure 3:
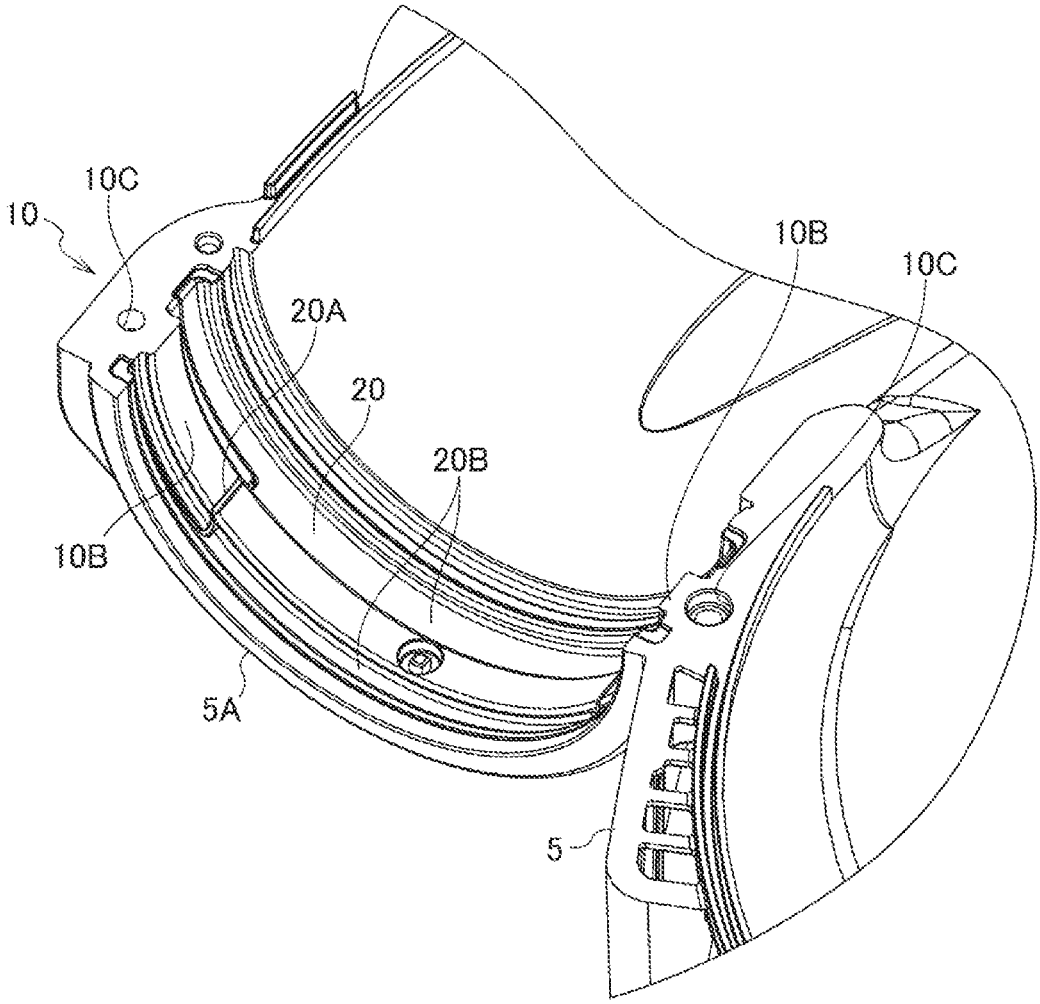
FIG. 3 is a perspective view showing an internal structure of a pipe connecting portion of the portable blower (after the slide-contact-receiving member is attached)

FIGS. 2 and 3 each shows an internal structure of the pipe connecting portion 10, that is, an exploded view of an internal structure of one split piece of a pair of the split bodies of the pipe connecting portion 10. In the pipe connecting portion 10, a slide-contact-receiving member 20 formed of a wear-resistant material is attached as a separate member to a slide-contact point of the pipe base portion 7.

FIG. 2 shows a state obtained before the slide-contact-receiving member 20 is attached inside the pipe connecting portion 10, and FIG. 3 shows a state obtained after the slide-contact-receiving member 20 is attached inside the pipe connecting portion 10.

A holding portion 10A to which the slide-contact-receiving member 20 is attached is formed inside the pipe connecting portion 10. Also, a projecting portion 10B is provided inside the pipe connecting portion 10. The projecting portion 10B is formed partially along a circumferential direction of the pipe base portion 7 connected to the pipe connecting portion 10, and a joining portion (screw hole) 10C of the split bodies of the pipe connecting portion 10 is provided on the projecting portion 10B. A section excluding the projecting portion 10B is the holding portion 10A, and the slide-contact-receiving member 20 is attached to the section inside the pipe connecting portion 10 excluding the projecting portion 10B.

In the examples shown in FIGS. 2 and 3, the slide-contact-receiving member 20 is constituted as a pair of split members corresponding to the pair of split bodies of the pipe connecting portion 10. The slide-contact-receiving member 20 includes an engaging portion 20A that comes into engagement with an end portion of the projecting portion 10B of the pipe connecting portion 10. The holding portion 10A of the pipe connecting portion 10 is provided with a detent projection 10D, and the slide-contact-receiving member 20 is provided with a fitting portion fitted to this detent projection 10D. By being fitted to the detent projection 10D and having the engaging portion 20A that is engaged with the end portion of the projecting portion 10B, the slide-contact-receiving member 20 is held in a fixed manner by the holding portion 10A in relation to slide contact of the pipe base portion 7.

Figure 4:
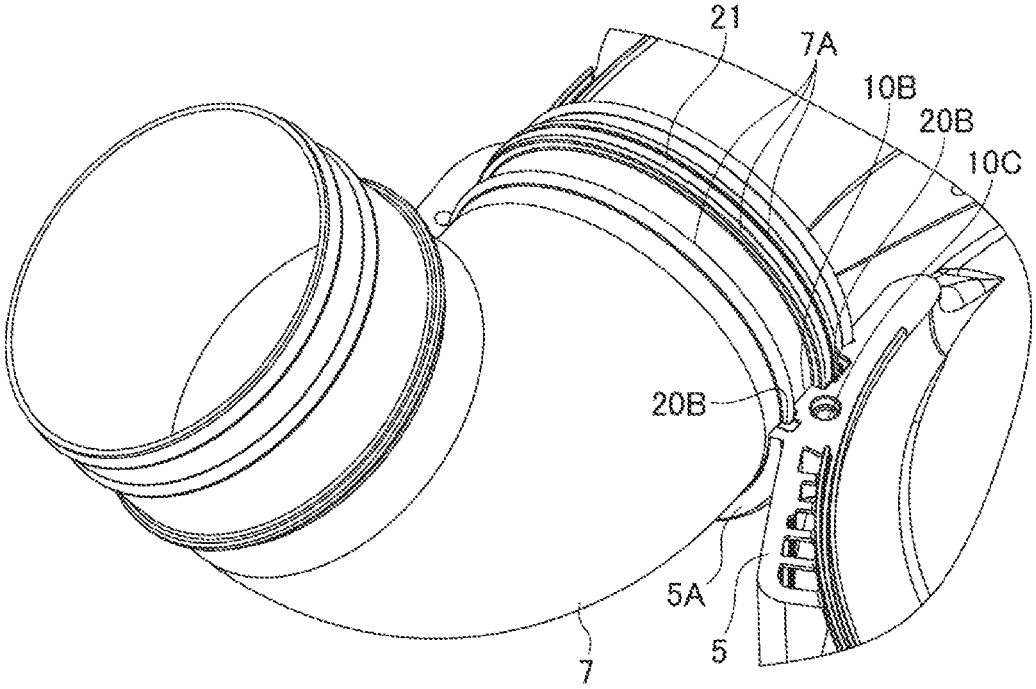
FIG. 4 is an explanatory diagram showing a state in which a pipe base portion is connected to the pipe connecting portion.
Figure 5:
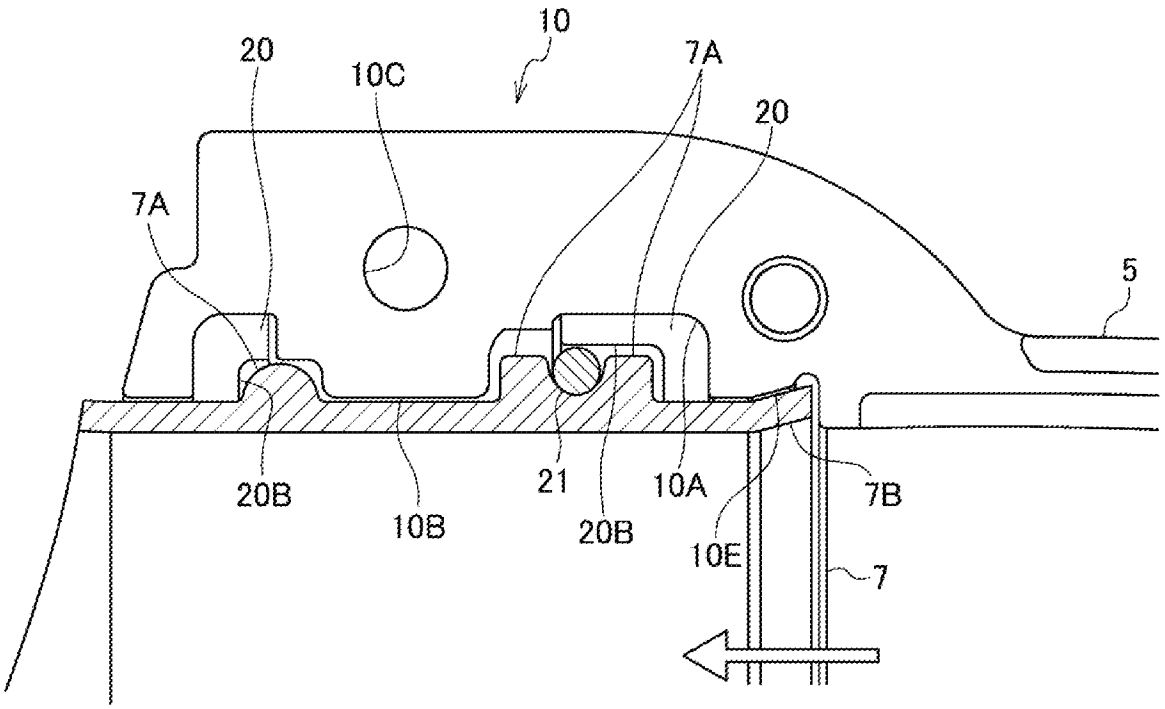
FIG. 5 is an explanatory diagram showing a state in which the pipe base portion is connected to the pipe connecting portion (cross-sectional view of the pipe base portion)

The slide-contact-receiving member 20 further includes a fitting portion 20B for holding the pipe base portion 7 in a retaining manner. As shown in FIGS. 4 and 5, when attaching the pipe base portion 7, a fitting projection 7A projecting outward along the circumferential direction of the pipe base portion 7 is fitted to the fitting portion 20B.

FIG. 5 shows a cross-sectional view of the pipe base portion 7 connected to the pipe connecting portion 10. The base end portion of the pipe base portion 7 is provided with a taper portion 7B, an inner surface of which expands in diameter toward a base end thereof, and a storing recess 10E for storing the taper portion 7B is provided inside the pipe connecting portion 10. An O-ring 21 is disposed in the fitting projection 7A of the pipe base end portion 7 in order to secure airtightness between the fitting projection 7A and the slide-contact-receiving member 20.

As shown by the arrow in FIG. 5, the taper portion 7B functions to guide an air flow, blown out from the fan case 5 into the pipe base portion 7, so as to prevent the air flow from entering a slide-contact part between an outer periphery of the pipe base portion 7 and the slide-contact-receiving member 20. By providing this taper portion 7B at the base end portion of the pipe base portion 7 and providing the storing recess 10E for storing the taper portion 7B in the pipe connecting portion 10, dust can be inhibited from entering the slide-contact part between the outer periphery of the pipe base portion 7 and the slide-contact-receiving member 20. According to this configuration, wear of the pipe connecting portion 10, attributed to slide contact of the pipe base portion 7, can be further reduced.

Figure 6:
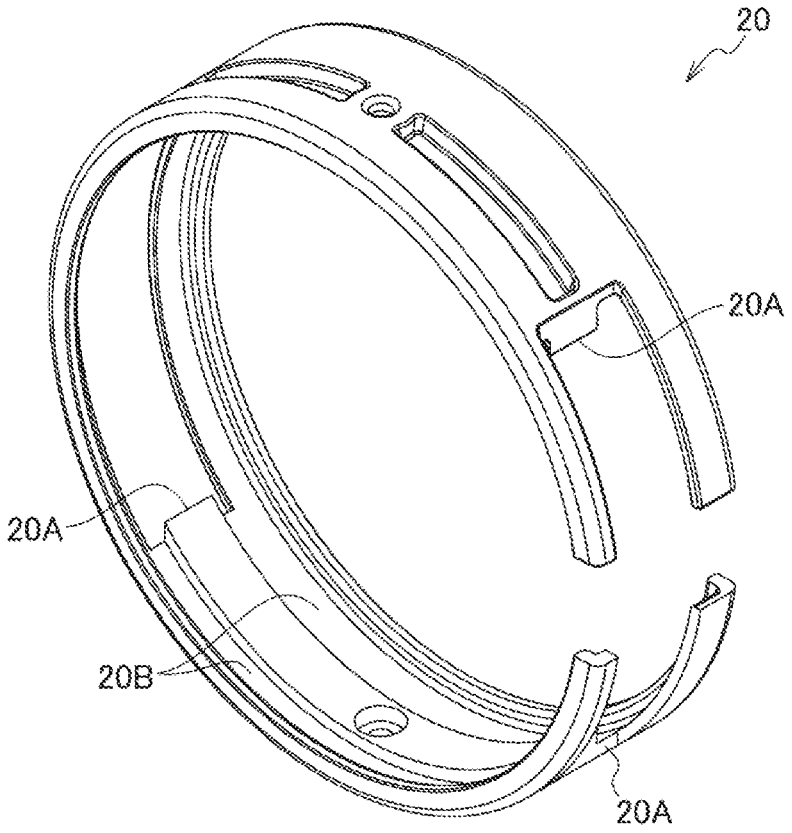
FIG. 6 is an explanatory diagram showing another constitution example of the slide-contact-receiving member.

The slide-contact-receiving member 20 is formed of a wear-resistant material. Examples of the wear-resistant material include glass fiber reinforced polyamide. Although the slide-contact-receiving member 20 can be constituted by the pair of split members described above, the slide-contact-receiving member 20 can also be constituted by a C-ring-type integrated body, as shown in FIG. 6. Moreover, the slide-contact-receiving member 20 may be formed of the same material as the pipe base portion 7.

As described above, according to the portable blower 1 of the embodiment of the present invention, the weight of the main body can be reduced by forming the fan case 5 from a fiber-reinforced resin of low specific gravity, thereby reducing the workload of the portable blower 1 which is used for tasks while carrying the main body thereof. Furthermore, even when a task involving sliding of the pipe base portion 7 of the blowout pipe 6 is repeatedly performed, attaching the slide-contact-receiving member 20 formed of the wear-resistant material to the slide-contact point of the pipe base portion 7 in the pipe connecting portion 10 can prevent such a problem as removal of the blowout pipe 6 attributed to wear of the pipe connecting portion 10.

In the portable blower 1, the pipe connecting portion 10 is constituted of a pair of split bodies for clamping the pipe base portion 7, the projecting portion 10B projecting toward the inside of the pipe connecting portion 10 is formed partially along the circumferential direction of the pipe base portion 7, the projecting portion 10B being provided with the joining portion 10C of the split bodies in the pipe connecting portion 10, and the slide-contact-receiving member 20 is attached to the section inside the pipe connecting portion 10 excluding the projecting portion 10B.

According to this configuration, the slide-contact-receiving member 20 can be attached inside the pipe connecting portion 10 including the joining portion 10C, without shifting the pipe connecting portion 10 to the outside of the fan case 5. In a case where the slide-contact-receiving member 20 is provided entirely on the inside of the pipe connecting portion 10 without providing the projecting portion 10B projecting partially toward the inside of the pipe connecting portion 10, the pipe connecting portion 10 including the joining portion 10C inevitably needs to be shifted to the outside of the slide-contact-receiving member 20. In such a case, the position of the pipe base portion 7 to be connected is shifted to the outside of the fan case 5, causing the blowout pipe 6 to swing left and right at a position away from the center of gravity of the main body (i.e., away from the body of the operator), and consequently increasing the workload. However, the portable blower 1 can prevent such problems, achieving favorable workability.

In the portable blower 1, the slide-contact-receiving member 20 can easily be attached to the pipe connecting portion 10 by configuring the slide-contact-receiving member 20 into the pair of split members corresponding to the pair of split bodies of the pipe connecting portion 10 as described above or by configuring the slide-contact-receiving member 20 into a C-ring shape as shown in FIG. 6.

The fitting portion 20B that is fitted to the fitting projection 7A projecting outward along the circumferential direction of the pipe base portion 7 is formed in the slide-contact-receiving member 20. Thus, wear of the fitting portion 20B attributed to a sliding motion of the pipe base portion 7 can be prevented by the wear-resistant material, and removal of the pipe base portion 7 from the pipe connecting portion 10 can be prevented by keeping the fitting projection 7A fitted in the fitting portion 20B.

In the portable blower 1, the slide-contact-receiving member 20 includes the engaging portion 20A coming into engagement with the end portion of the projecting portion 10B, and the holding portion 10A of the pipe connecting portion 10 is provided with the detent projection 10D for locking the slide-contact-receiving member 20. Therefore, the slide-contact-receiving member 20 moves as the pipe base portion 7 slides with respect to the pipe connecting portion 10, and this movement of the slide-contact-receiving member 20 can prevent wear of the holding portion 10A.

In the portable blower 1, in a case where the slide-contact-receiving member 20 wears, the slide-contact-receiving member 20 only needs to be replaced, keeping part replacement to the minimum at the time of maintenance. Thus, when using the portable blower 1 such that the pipe base portion 7 is slid repeatedly, the whole fan case does not need to be replaced.

Although the slide-contact-receiving member 20 is attached as a separate member to the fan case, the slide-contact-receiving member 20 is placed only in the slide-contact point of the pipe base portion 7. Therefore, an increase in the weight of the entire fan case can be suppressed to a minimum. In the configuration shown in FIG. 2, two of the slide-contact-receiving members 20 are used, but since the two slide-contact-receiving members 20 are in an identical shape, essentially only one slide-contact-receiving member 20 needs to be designed, which is beneficial in terms of minimizing an increase in production cost.

In the portable blower 1, the base end portion of the pipe base portion 7 is provided with the taper portion 7B, the inner surface of which expands in diameter toward the base end thereof, and the storing recess 10E for storing the taper portion 7B is provided inside the pipe connecting portion 10. According to this configuration, the air flow blown out of the fan case 5 can be allowed to smoothly flow into the pipe base end portion 7, and entry of dust into the slide-contact part between the outer periphery of the pipe base portion 7 and the slide-contact-receiving member 20 can be inhibited. Consequently, wear of the pipe connecting portion 10 attributed to slide contact of the pipe base portion 7 can be further reduced.

Although the embodiment of the present invention has been described above in detail with reference to the drawings, specific constitutions of the present invention are not limited thereto, and design modifications and the like not departing from the gist of the present invention are also included in the present invention.

EXPLANATION OF REFERENCE NUMERALS

1 Portable blower
2 Machine frame (backpack base)
3 Fan
4 Prime mover
5 Fan case
5A Outlet port
6 Blowout pipe
7 Pipe base portion
7A Fitting projection
7B Taper portion
10 Pipe connecting portion
10A Holding portion
10B Projecting portion
10C Joining portion (joining hole)
10D Detent projection
10E Storing recess
20 Slide-contact-receiving member
20A Engaging portion
20B Fitting portion
21 O-ring

What is claimed is:

1. A portable blower comprising a portable main body in which a pipe base portion of a blowout pipe is connected to an outlet port of a fan case, wherein, the fan case is formed of a carbon fiber-reinforced resin of low specific gravity, the pipe base portion has a bent shape and is connected slidably to a pipe connecting portion of the outlet port, a slide-contact-receiving member that is formed of a wear-resistant material is attached to the pipe connecting portion at a slide-contact point of the pipe base portion, and the slide-contact-receiving member is configured to move as the pipe base portion slides with respect to the pipe connecting portion such that wearing of the pipe connecting portion is reduced.

2. The portable blower according to claim 1, wherein the pipe connecting portion is constituted of a pair of split bodies for clamping the pipe base portion, a projecting portion projecting toward the inside of the pipe connecting portion is formed partially along a circumferential direction of the pipe base portion, the projecting portion being provided with a joining portion of the split bodies in the pipe connecting portion, and the slide-contact-receiving member is attached to a section inside the pipe connecting portion excluding the projecting portion.

3. The portable blower according to claim 2, wherein the slide-contact-receiving member is a pair of split members corresponding to the split bodies.

4. The portable blower according to claim 2, wherein a fitting portion configured to be fitted to a fitting projection projecting outward along the circumferential direction of the pipe base portion is formed in the slide-contact-receiving member.

5. The portable blower according to claim 2, wherein the slide-contact-receiving member comprises an engaging portion configured to engage with an end portion of the projecting portion.

6. The portable blower according to claim 2, wherein a base end portion of the pipe base portion is provided with a taper portion, an inner surface of which expands in diameter toward a base end thereof, and a storing recess for storing the taper portion is provided inside the pipe connecting portion.

7. The portable blower according to claim 1, wherein the slide-contact-receiving member is formed of the same material as the pipe base portion.

8. The portable blower according to claim 1, wherein a material of the fan case is carbon fiber reinforced polypropylene, and a material of the slide-contact-receiving member is glass fiber reinforced polyamide.

9. The portable blower according to claim 1, wherein the pipe connecting portion comprises a holding portion, and the holding portion comprises a detent projection configured to lock the slide-contact-receiving member.

* * * * *